United States Patent [19]

Spanel et al.

[11] 4,154,176

[45] May 15, 1979

[54] TUFTING NEEDLE BAR AND NEEDLE BAR ASSEMBLY

[76] Inventors: Abram N. Spanel, 344 Stockton St., Princeton, N.J. 08540; P. Frank Eiland, 52 Windsor Rd., Stamford, Conn. 06905; David R. Jacobs, 211 Old Norwalk Rd., New Canaan, Conn. 06840

[21] Appl. No.: 811,957

[22] Filed: Jun. 30, 1977

[51] Int. Cl.[2] ..... D05C 15/10

[52] U.S. Cl. ..... 112/79 R; 403/324; 403/379

[58] Field of Search ..... 112/79 R, 79 A, 79 FF, 112/79.5, 78, 226, 221; 403/324, 378, 379, 186

[56] References Cited

U.S. PATENT DOCUMENTS

| | | | |
|---|---|---|---|
| Re. 27,165 | 8/1971 | Spanel et al. | 112/79 R |
| 418,049 | 12/1889 | Muther | 112/226 |
| 3,217,676 | 11/1965 | Short | 112/79 R |
| 3,342,153 | 9/1967 | Short | 112/79 FF |
| 3,348,508 | 10/1967 | Eguchi et al. | 112/226 |
| 3,424,114 | 1/1969 | Short | 112/79 FF |
| 3,485,195 | 12/1969 | Torrence | 112/79 R X |
| 3,534,640 | 10/1970 | Macy | 403/378 X |
| 3,658,022 | 4/1972 | Roger | 112/226 |
| 3,937,157 | 2/1976 | Spanel et al. | 112/79 FF |

FOREIGN PATENT DOCUMENT

| | | | |
|---|---|---|---|
| 686,665 | 1/1953 | United Kingdom | 403/324 |

*Primary Examiner*—H. Hampton Hunter
*Attorney, Agent, or Firm*—J. Rodman Steele, Jr.

[57] ABSTRACT

A substantially lightweight tufting needle bar and needle bar assembly of improved construction comprising preferably a hollow needle bar including a needle bar insert pin plate or base type portion having vertical bores for receiving needles. Horizontal bores intersect with the vertical bores to permit the insertion of roll pins which secure and lock the needles in place. The needles are horizontally grooved to enable precise securement by the roll pins. In the hollow needle bar embodiment, the outer channel of the needle bar is kept thin to provide an extremely light weight construction.

19 Claims, 9 Drawing Figures

TUFTING NEEDLE BAR AND NEEDLE BAR ASSEMBLY

BACKGROUND OF THE INVENTION

The subject application discloses an improved tufting needle and needle bar assembly for use in various types of tufting apparatus. The assembly has particular utility in pneumatic tufting apparatus which have been developed by Abram N. Spanel. Generally, this system utilizes pneumatic means to transport yarn to a tufting station where the yarn is tufted by multiple needles into a backing layer to form a tufted product. Basic techniques of some of the embodiments of the Spanel system are disclosed in U.S. Pat. No. 3,554,147 which issued to Abram N. Spanel and George J. Brennan on Jan. 12, 1971 and U.S. Pat. No. Re. 27,165 which issued Aug. 10, 1971 to Abram N. Spanel and Loy E. Barton.

The aforementioned U.S. Pat. No. Re. 27,165 discloses a pneumatic yarn transport system in which yarn strands and/or discrete bits of yarn are transported pneumatically to a tufting station where they are applied by tufting elements to a backing layer. In one embodiment, the tufting elements comprise dual needles wherein for each tufting station a set of dual needles are provided with aligned eyes. This type of needle is utilized to tuft U-shaped tufts into a backing layer.

The aforementioned U.S. Pat. No. 3,554,147 describes further embodiments of pneumatic tufting and provides for the simultaneous selection of bit-lengths of yarn of various colors for each tufting cycle at each individual tufting station. Needles on the order of those disclosed in aforementioned U.S. Pat. No. Re.27,165 receive yarn strands after which the yarn is severed to leave a discrete bit-length of yarn loaded for tufting in each set of dual needles. Multi-color selection is available for each needle station and an entire tufting machine may comprise as many as 1200 such needle stations.

In such a system as well as any tufting operation, it is advantageous to minimize the weight of the apparatus and at the same time, construct components to be durable yet easily maintainable. Standard needle bar construction in the past has called for a solid bar having bores to receive needles which are held in place by set screws. There have been constructions in the past which depart from the above standard construction, such as the combined needle bar and air manifold construction of J. T. Short as disclosed in U.S. Pat. No. 3,447,496 of June 3, 1969, however, such constructions do not provide the lightweight yet durable characteristics which have been a major objective with respect to the subject invention.

BRIEF SUMMARY OF THE INVENTION

In accordance with the subject invention, the needle bar and needle bar assembly disclosed herein includes a needle bar which comprises in the preferred embodiment an outer channel or shell of relatively small thickness which is hollow within to minimize the weight of this element. A needle bar insert pin plate is secured within the sides of the outer channel which acts as the locking member for the tufting needles. Both the outer channel and needle bar insert plate have aligned bores for the needles and the needle bar insert pin plate also has lateral bores for roll pins which secure the needles in position. Each needle utilized with the preferred needle bar has a locking groove which when properly positioned will be mated with a securing roll pin to lock the needle in position. A single roll pin may be sufficiently dimensioned and positioned so as to secure adjacent needles.

The needle bar construction may further comprise a needle bar base plate or base pads with mounting means to secure the unit to surrounding machine structure. In the alternative, the needle bar base plate with its mounting means may be combined with the needle bar insert pin plate and thus, the needles will be locked within the base plate. In a further embodiment, the locking and mounting features disclosed herein may be incorporated into a solid lightweight needle bar constructed as for example from titanium or beryllium.

As adapted to the Spanel tufting system utilizing dual needles at each tufting station, accommodating bores extend through both the needle bar outer channel and the needle bar insert pin plate. With such an arrangement, each roll pin may in fact be utilized to secure four needles in position, i.e., the two needles of each tufting station as well as those of an adjacent station.

Utilizing the teachings of the subject invention, an extremely lightweight needle bar can be constructed which is durable and which provides a means of quickly removing and replacing needles with the precise alignment thereof being ensured.

BRIEF DESCRIPTION OF THE DRAWINGS

For a more detailed understanding of the invention, reference is made in the following description to the accompanying drawings in which.

DETAILED DESCRIPTION

Figure 1:
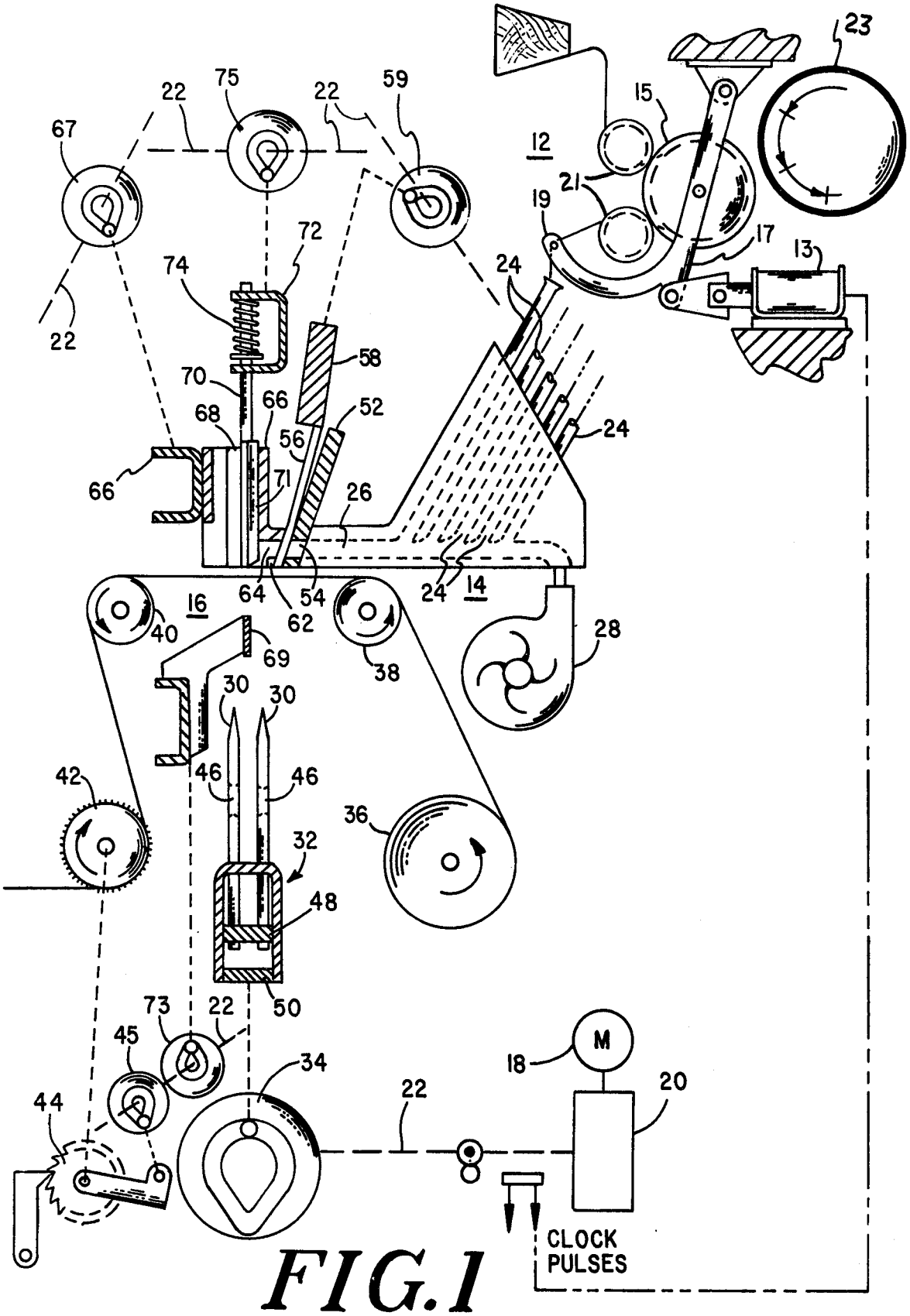
FIG. 1 discloses a schematic view of one embodiment of the tufting apparatus in which the subject needle bar assembly may be utilized.

With reference to FIG. 1, tufting apparatus as disclosed herein includes yarn selection and metering apparatus 12, pneumatic transport apparatus 14, and a tufting station 16. Each tufting station 16 is representative of as many as 1200 such tufting stations and for each tufting station there will be available some five or eight yarn strands each representing a different color or some other variable.

Control signals for operation of each selection actuation means for each selection and metering apparatus may be provided by any of various readout devices. To produce a desired pattern on a backing layer, pattern information recorded on tapes, drums or other medium is converted into electrical or other types of signals which, at the proper time with regard to the machine tufting cycle, as indicated by the dashed clock pulses of FIG. 1, are transmitted to the actuation means 13 for the yarn selection and metering apparatus. The selection actuator 13 may be a solenoid or it may be any suitable one of a variety of electrical, thermal, pneumatic or hydraulic, etc. type actuators. For details of selection and metering in the Spanel tufting system aforementioned U.S. Pat. Nos. 3,554,147 and Re. 27,165 should be consulted as well as U.S. Pat. No. 3,937,157 of which Abram N. Spanel and David R. Jacobs are inventors and co-pending application Ser. No. 699,904. A rotatable yarn feed mechanism 15 which may be on the order of that disclosed in U.S. Pat. No. 3,937,157 is shown in FIG. 1 together with intermediate linkage means 17 which extends from actuator 13 to rotatable yarn feed mechanism 15 and which also controls the yarn pull-back mechanism 19 fully described in U.S. Pat. No. 3,937,157. The yarn feed mechanism also includes yarn guides 21 and drive roll 23. The selection and metering system including yarn pull-back means of co-pending application Ser. No. 699,904 may be used as well as the rotatable yarn feed mechanism.

A motor 18 is shown driving the machine by means of drive transmission 20 which may be a train of gears or comprise other mechanisms. A shaft 22 is schematically shown running throughout the device from which drive mechanisms operate as will be described subsequently.

Briefly, specific color selection signals are generated in response to the color requirements of a desired pattern, and for each of the color selection signals transmitted to a selection actuation means 13, a predetermined length of selected yarn is metered by yarn selection and metering apparatus 12 and advanced by pneumatic transport apparatus 14 through yarn guide tubes 24 so that the selected yarn strand extends into a common passageway 26 leading to tufting station 16 where it will be cut and the resultant yarn bit tufted into backing layer L. A pneumatic source 28 schematically shown provides the pneumatic supply for pneumatic transport apparatus 14. Reference may once again be made to U.S. Pat. No. 3,937,157 or co-pending Application Ser. No. 699,904 for suitable pneumatic systems. The pull back mechanism 19 which is part of the yarn selection and metering apparatus 12 will remove the last-selected yarn strand from the common passageway 26 adjacent the tufting station after severance of the yarn bit, preparatory to the next color selection by the control signals.

At the tufting station, tufting needles 30 with aligned eyes receive the yarn strands preparatory to tufting. The needles 30 are mounted on a needle bar 32 which via cam drive 34 provides reciprocable motion to the needles 30.

The backing L may be fed from a supply roll 36 over roller member 38. Idler roll 40 directs the tufted product to the take-up pin roll 42 which operates from the ratchet and pawl mechanism 44 functioning off cam drive 45.

Figure 2:
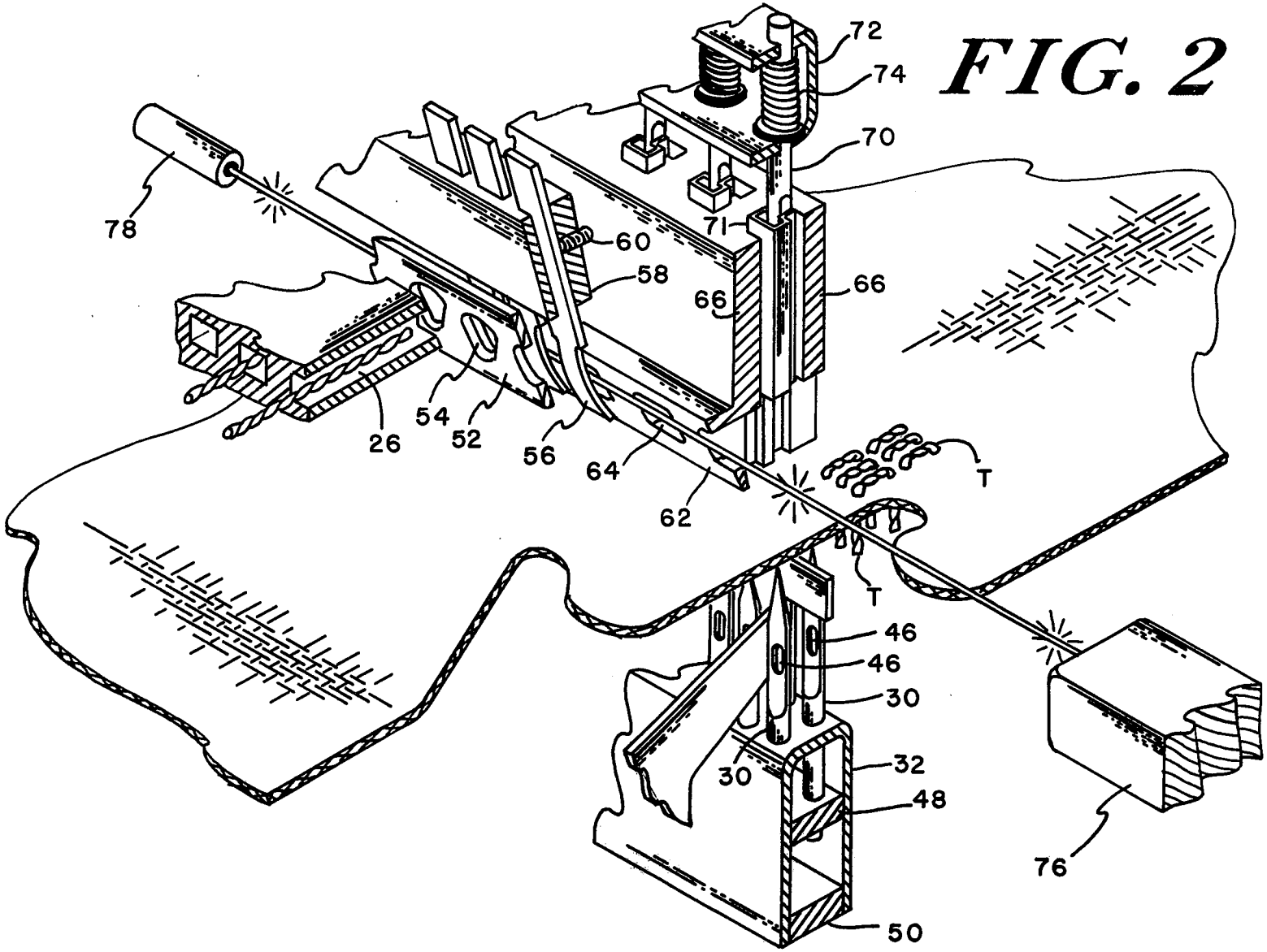
FIG. 2 is a perspective view showing a tufting station including the needle bar assembly.

With reference to FIG. 1 and FIG. 2, the tufting station 16 is shown comprising needles 30 which have aligned eyes 46. Each individual tufting station comprises dual needles 30 on the order of those disclosed in aforementioned U.S. Reissue Pat. No. Re. 27,165. A needle bar 32 of lightweight construction aligns the needles 30 which are secured within the needle bar by needle bar insert member 48. A needle bar base plate 50 serves as mounting means for standard linkage structure which will drive the needle bar 32 by cam drive 34.

With further reference to FIGS. 1 and 2, a cutter mechanism stationary blade 52 having openings 54 is positioned adjacent common passageway 26 through which yarn extends toward each tufting station 16. Immediately adjacent the stationary blade 52, reciprocating blades 56 are positioned which are secured to reciprocating blade holder 58 which reciprocates in a widthwise direction with respect to the machine. This reciprocation is shown schematically as being provided by cam 59 in FIG. 1. Each individual reciprocating blade 56 is secured to reciprocating blade holder 58 by a locking and adjustment means 60 which may be on the order of a set screw device.

Adjacent the reciprocating blades, yarn adjuster 62 is shown having yarn openings 64 which align with the openings 54 of the stationary blade 52 to enable yarn strands to be pneumatically fed through to the tufting needles 30. The yarn adjustor 62 provides the tufting apparatus with the capability of selecting and tufting yarn of different lengths to produce rugs of different pile heights either on the same or different rugs. With reference to FIG. 2, U-shaped tufts are disclosed and it can be appreciated from FIGS. 1 and 2 that if different yarn lengths are metered by the yarn selection and metering apparatus 12 in the absence of some adjustment means, unequal tufts will result which will be of the nature of J-shaped rather than U-shaped since more or less yarn will be fed to the right of the needles 30 than the amount of yarn to the left of the needles 30 between the needles 30 and the cutting mechanism. Thus in constructing the apparatus disclosed herein, it is preferred to have the distance between the needles 30 and the reciprocating blade 56 be equal to the shortest tuft-leg length that will be produced on the machine. If longer tufts are desired, the additional necessary yarn is advanced by the metering means 12 and pneumatically fed to the needles 30 with the additional yarn being fed to the right of the needles 30. The yarn adjuster 62 will then rise lifting the yarn and pulling back one half of the additional yarn to the left of the needles prior to severance by the reciprocating blade 56 so that each tuft-leg will be equal and U-shaped tufts will result. It will be appreciated that the above designations of right and left of the needles were directed to the view as shown in FIG. 2. The terms should be reversed when viewing FIG. 1.

Yarn adjuster carrier bar 66 is shown being an integral part of the yarn adjuster 62 and vertical reciprocation of the yarn adjuster carrier bar 66 is enabled through linkage by eccentric member 67 schematically shown in FIG. 1.

Yarn bit clamps 70 are shown which clamp the yarn against the backing layer L prior to tufting by the needles 30 and before, during or after severance of the yarn. A shiftable support member 69 is provided opposite the backing layer L from the clamps 70 to provide support for the backing layer. The support member 69 is controlled by cam member 73 and is cleared from its support position as the backing layer L is advanced.

The yarn bit clamp 70 is shown having hollow shields 71 into which extend the needle 30 of each needle pair which is closest to the yarn adjuster 62. The shield serves to prevent impalement of the yarn by the shielded needle 30 as it descends in close proximity to the yarn adjuster 62.

The yarn adjuster carrier bar 66 is shown having channels 68 through which the bit clamps 70 are permitted to reciprocate as does yarn adjuster carrier bar 66 although independent of each other. The bit clamps 70 are secured to bit clamp carrier bar 72 which is shown housing spring means 74 supported by flange support 148 for each of the individual bit clamps 70. As shown in FIG. 1, cam 75 provides the vertical reciprocation for carrier bar 72.

A laser 76 is shown which will be positioned on one extreme side of the machine while a photo-detector 78 will be positioned at the opposite side of the laser aligned therewith so that the laser beam may be used to detect the presence of yarn in any of the channels at a time when such yarn should not be present. The presence of yarn at such a time indicates a malfunction.

Figure 3:
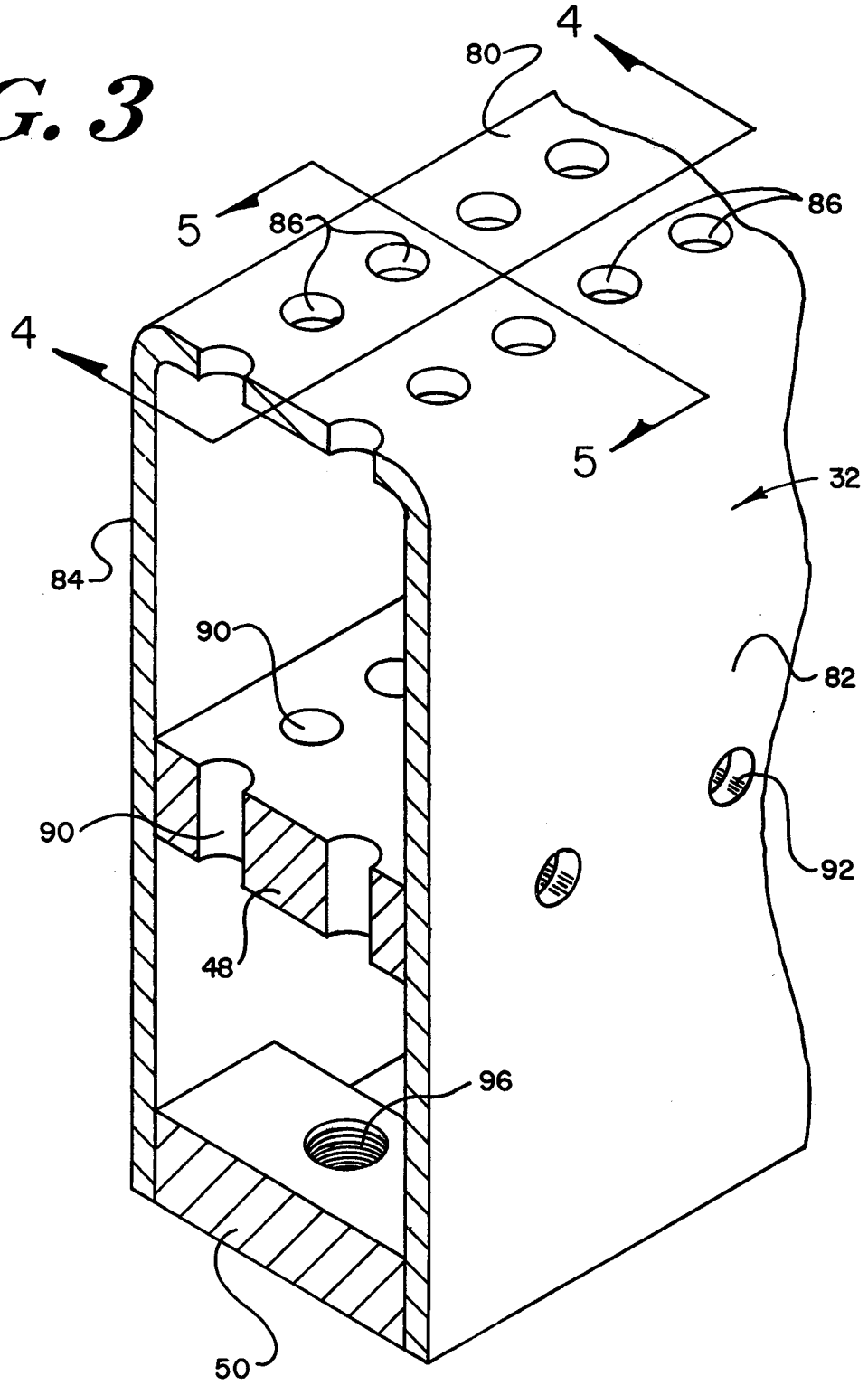
FIG. 3 is a perspective view showing a portion of the lightweight needle bar.

With reference to FIG. 3, the needle bar 32 is shown having an outer shell or channel of U-shaped configuration comprising a cross member 80 and sides 82 and 84. Elements 80, 82 and 84 are preferably of integral construction and may have a thickness on the order of 0.04 inches. Cross member 80 is shown having dual needle bores 86 to receive, align and guide needles 30 of the Spanel dual type for each tufting station. The needle bar 32 is preferably constructed of milled steel.

The needle bar insert member or pin plate 48 is shown having needle bores 90 which correspond to the needle bores 86 of the outer channel cross member 80. The needle bar insert also is preferably constructed of steel.

Lateral bores 92 are shown through side member 82, which bores correspond to lateral bores in the needle bar insert member or pin plate 48 which extend across the width of the needle bar pin plate 48 and which are substantially perpendicular to needle bores 86. Both sides 82 and 84 have corresponding lateral bores as depicted by bore 92 in FIG. 3.

The needle bar base plate 50 is shown having mounting bores 96 for securing the needle bar base plate 50 to needle bar driving elements and standard intermediate linkage which extends from the needle bar 32 to the driving means such as cam 34 of FIG. 1. Both the needle bar pin plate 48 and the needle bar base plate 50 may be spot welded or otherwise secured to the sides 82 and 84. The needle bar base plate 50 may in fact be a series of pads which are each approximately three inches long and which are mounted every eighteen inches to correspond to the locations of standard push rod feet or other linkage which is secured to the needle bar 32 by means of the base plate 50 or base pads.

Cross member 80 may be viewed as a first member with a function to guide and align needles. Needle bar insert member 48 may be viewed as a second member with a function to align and secure the needles and base plate 50 may be viewed as a third member to which drive means is secured. The three members are at different levels and are joined together by joining structure such as sides 82 and 84.

Figures 4, 5, 5A:
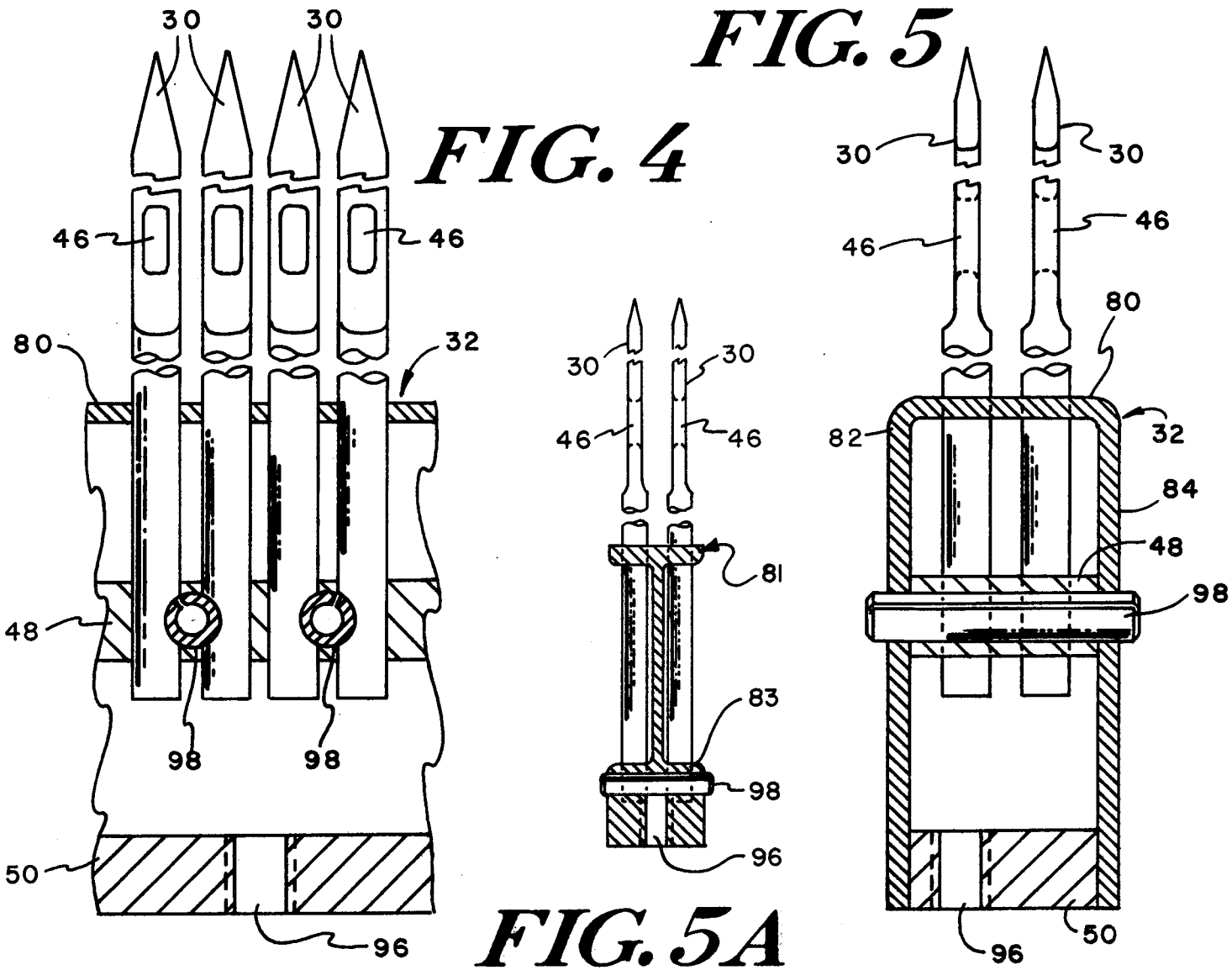
FIG. 4 is a cross-sectional view taken along the lines 4—4 of FIG. 3 and including needles.
FIG. 5 is a cross-sectional view taken along the lines 5—5 of FIG. 3 and including needles.
FIG. 5A is a side view of an alternate embodiment for a needle bar in accordance with the subject invention.

With reference to FIG. 4, a series of four needles 30 are shown in position with roll pins 98, each securing two of the adjacent needles 30. Needle grooves 100 (see FIG. 6) of the needles 30 receive roll pins 98 and once the roll pins 98 have been inserted as shown in FIG. 4, the needles are rigidly locked in position and cannot be removed until the roll pins 98 are removed.

As shown in FIG. 4 and FIG. 5, roll pins 98 are substantially annular cylinders with a longitudinal slit running the length of the pin. In use, a clamping tool is used to compress the pins by closing the slit and thereby decreasing the diameter. When the pins are inserted at least partially into the lateral bore 92, the clamping tool can be removed. The pins will spring back to their original diameter, but can easily be tapped completely into the bores. When the needles must be replaced, the pins can be easily tapped out of the bores as well. Preferably, the pins are provided with beveled edges to facilitate insertion and removal.

With reference to FIG. 5, a cross-sectional view of the needle bar 32 is disclosed showing dual needles 30 of a single tufting station such as is used for the Spanel tufting apparatus. As can be seen, the roll pin 98 locks the two needles 30 which comprise a single needle station into position and as was seen in FIG. 4, also the two needles of an adjacent tufting station.

With reference to FIG. 5A, there is shown an alternate embodiment wherein the needle bar, the needle bar insert and the needle bar base plate are combined into an integral "I" beam member 81. The needles 30 are inserted through and held in alignment by bores 83. The needles are locked in place by roll pins 98, mounted through cross bores in the larger base portion of member 81. "I" beam member 81 is also provided with a mounting bore 96 for securement to the needle bar driving elements.

Figure 6:
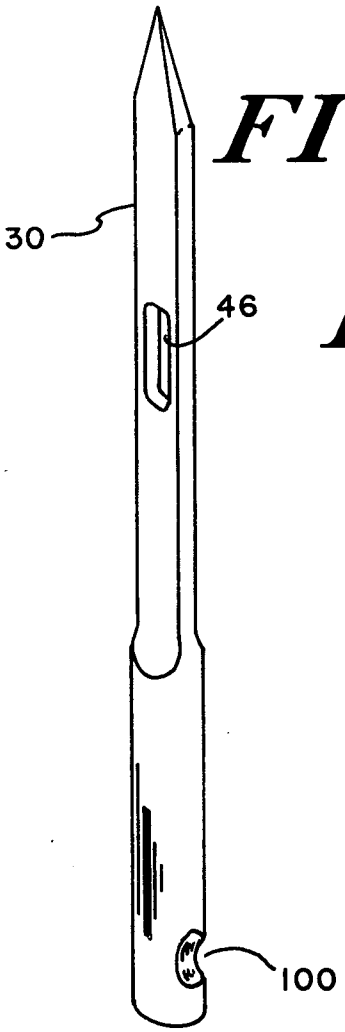
FIG. 6 is a perspective view showing a needle adapted for use with the subject invention.

A typical needle 30 is shown in FIG. 6 with eye 46 and the roll pin locking groove 100 clearly depicted. The groove 100 is preferably a radius cut into the shank which will provide a snug fit when the needle 30 is extended through bores 86 and 90 and secured by roll pin 98.

Figure 7:
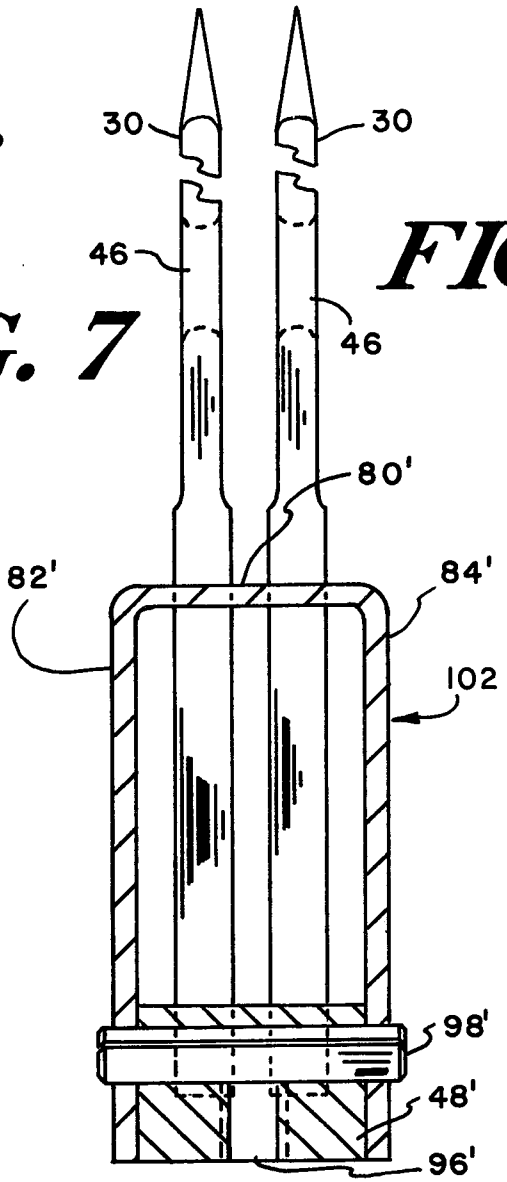
FIG. 7 is a cross-sectional view of a modified embodiment disclosing the use of a single member as a needle locking and needle bar mounting member.

With reference to FIG. 7, an alternate embodiment of a needle bar 102 and needle bar assembly is disclosed wherein the overall configuration including cross-piece 80' and sides 82' and 84' is similar to the embodiment of FIG. 3. In this embodiment, needle bar insert pin plate 48' additionally serves as the mounting or base plate and includes mounting bores 96'.

Figure 8:
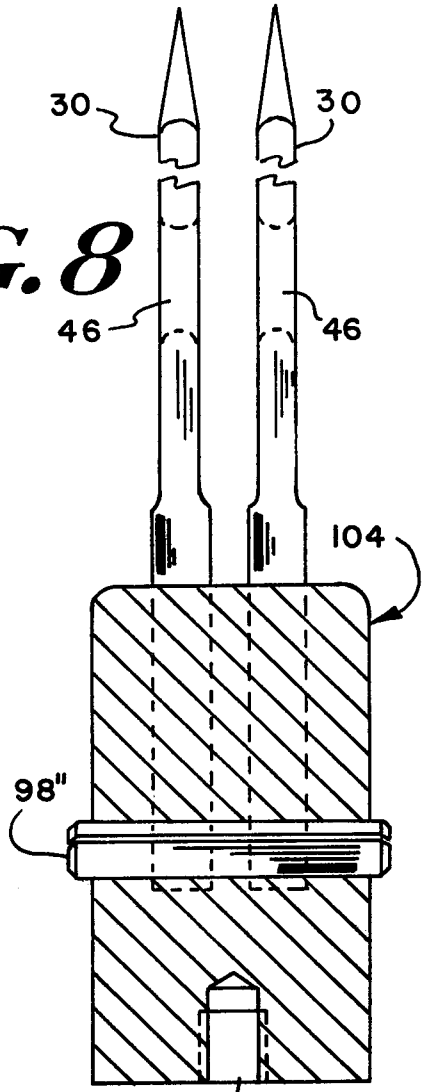
FIG. 8 is a cross-section view of a modified embodiment similar to FIG. 7 except showing a solid needle bar.

With reference to FIG. 8, another alternate embodiment is disclosed in which the needle securement means of the preceding embodiments is utilized with a solid needle bar 104 preferably constructed of a lightweight but strong material such as titanium or beryllium. Needle bores extend into the needle bar 104 where they are intersected by the lateral bores for roll pin 98". Mounting bores 96" are located as needed.

Co-pending application Ser. Nos. 811,969, 811,968, 811,970 and 811,955 should be consulted for further description of the cutter mechanism 52, 56, laser detector 76, 78, bit clamp 70, 71 and yarn adjuster 62.

The present invention may be embodied in other specific forms without departing from the spirit or essential attributes thereof, and, accordingly, reference should be made to the appended claims, rather than to the foregoing specification as indicating the scope of the invention.

What is claimed is:

1. Tufting apparatus or the like having tufting stations including tufting needles for applying tufts to a backing layer, wherein the improvement includes a needle bar comprising:

a member for carrying said tufting needles;

means for positioning said tufting needles on said member; and, unitary means for simultaneously rotationally and axially aligning said tufting needles, including adjacent structure on said tufting needles and said member, and insertable means for engaging said adjacent structure and said positioning means, thereby aligning and securing said tufting needles.

2. A tufting apparatus or the like of claim 1 wherein said needle bar includes a housing for said member, said housing and said member having bores which are aligned to house dual needles at each said tufting station, said bores forming said positioning means.

3. The tufting apparatus or the like of claim 2 wherein each of said roll pins locks four needles in position.

4. The tufting apparatus or the like of claim 1 further having mounting means for securement of drive means to said needle bar.

5. The tufting apparatus or the like of claim 4 further including a U-shaped housing for said member and a needle bar base plate.

6. The tufting apparatus or the like of claim 4 wherein said member and said needle bar base plate are the same member.

7. The tufting apparatus or the like of claim 1 wherein said adjacent structure includes bores through said member and grooves on said tufting needles.

8. The tufting apparatus or the like of claim 1 wherein said insertable means are pin-like members.

9. The tufting apparatus or the like of claim 1 wherein said insertable means engage by contact with said corresponding structure.

10. The tufting apparatus or the like of claim 1 wherein said insertable means are engageable roll pins.

11. The tufting apparatus or the like of claim 1 wherein said positioning means and said corresponding structure on said member form intersecting bores.

12. Tufting apparatus or the like including tufting needles for applying tufts to a backing layer wherein the improvement includes a needle bar comprising:

a first member having means to guide needles;

a second member having locking and aligning means for securing needles thereto in precise axial and rotational alignment; and, a third member which has mounting means for securing needle driving means thereto, each of said three members being secured to one another by joining structure.

13. The tufting apparatus or the like of claim 12 wherein each of the three members are removed from one another.

14. The tufting apparatus or the like of claim 12 wherein said joining structure includes side panels.

15. The tufting apparatus or the like of claim 12 wherein said tufting needles have grooves which mate with said locking means of said second member.

16. The tufting apparatus or the like of claim 12 wherein the means to guide and align the needles are bores.

17. The tufting apparatus or the like of claim 12 wherein said locking means comprises bores which house locking roll pins.

18. The tufting apparatus or the like of claim 7 wherein each of the three members has a space therebetween.

19. Tufting apparatus or the like having tufting stations including tufting needles for applying tufts to a backing layer and a needle bar for carrying said tufting needles comprising:

first bore means in said needle bar into which said tufting needles can be inserted;

second bore means in said needle bar which intersects said first bore means;

said tufting needle, including receiving portions alignable with said second bore means in said needle bar; and insertable pin means which unitarily will rotationally and axially align and secure said tufting needles upon insertion of said pin means in said second bore means when said receiving portions of said tufting needles are aligned with said second bore means.

* * * * *

UNITED STATES PATENT OFFICE

CERTIFICATE OF CORRECTION

Patent No. 4,154,176 Dated May 15, 1979

Inventor(s) Abram N. Spanel, P. Frank Eiland, and David R. Jacobs

It is certified that error appears in the above-identified patent and that said Letters Patent are hereby corrected as shown below:

Column 1, line 65, after "insert", insert --pin--.

Column 5, line 25, delete "milled", and insert --mild--.

Column 8, line 19, delete "7", and insert --12--.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*